United States Patent [19]

Hein et al.

[11] 4,113,144

[45] Sep. 12, 1978

[54] SYRINGES ADAPTED TO OVERCOME A PRESSURE RESISTANCE

[76] Inventors: Wolfgang Hein, Hahnstrasse, 3354 Dassel; Peter Grundmann, Amselweg, 5330 Konigswinter; Claus Cosack, Südstrasse, 3354 Dassel, all of Fed. Rep. of Germany

[21] Appl. No.: 783,714

[22] Filed: Apr. 1, 1977

[30] Foreign Application Priority Data

Apr. 4, 1976 [DE] Fed. Rep. of Germany ..... 2615366

[51] Int. Cl.[2] ..... B65D 83/14

[52] U.S. Cl. ..... 222/396; 222/401; 73/425.4 P; 128/237

[58] Field of Search ..... 222/396, 397, 401, 402; 128/220, 237, 218 M; 141/67, 27; 73/425.4 P

[56] References Cited

U.S. PATENT DOCUMENTS

| | | | |
|---|---|---|---|
| 1,435,034 | 11/1922 | Ullman | 222/401 X |
| 1,623,101 | 4/1927 | Fisher | 222/401 X |
| 1,636,711 | 7/1927 | Nicoll | 222/397 |
| 1,751,128 | 3/1930 | Cocks | 222/401 X |
| 2,049,851 | 8/1936 | Madan | 222/396 |
| 3,635,218 | 1/1972 | Ericson | 128/220 X |
| 3,685,514 | 8/1972 | Cheney | 128/220 X |

*Primary Examiner*—Robert B. Reeves
*Assistant Examiner*—Francis J. Bartuska
*Attorney, Agent, or Firm*—Fulwider, Patton, Rieber, Lee & Utecht

[57] ABSTRACT

A syringe of the slide piston pump type is adapted to overcome a pressure resistance at its outlet as may be provided, for instance, by a filter in communication with the outlet and through which the syringe is to pump a medium, particularly a liquid medium, for filtration. The syringe comprises a cylinder containing a piston, and a piston rod. The piston rod is fixed to a second piston sliding within a longitudinal bore in the first-mentioned piston. The bore and the second piston cooperate to define an air-filled pressure chamber connected to a cylinder chamber, defined by the first piston and the cylinder, by a valve. Inward movement of the piston rod produces an over-pressure (e.g. 16 atmospheres) in the pressure chamber to open the valve to apply the over-pressure to the liquid or other medium in the cylinder chamber to overcome the pressure resistance of the filter and enable the liquid to be forced through the filter. A safety pressure release is provided to prevent bursting or inadvertent release of the liquid medium.

5 Claims, 3 Drawing Figures

SYRINGES ADAPTED TO OVERCOME A PRESSURE RESISTANCE

BACKGROUND OF THE INVENTION

1. Field of the Invention

The invention relates to a syringe comprising a cylinder, a piston rod and a piston disposed for displacement within the cylinder by displacement of the piston rod, whereby when the piston rod is displaced in one direction a medium is drawn into the interior of the cylinder while when the rod is displaced in the opposite direction the medium is expelled from the cylinder.

2. Description of the Prior Art

Such syringes are used, for example, for forcing media through filters. In this case, a filter assembly disposed in a filter holder may be connected to the outlet of the syringe. Such arrangements are used, for example, for the cleaning or sterile filtration of small quantities of liquid. In order, then, to propel the liquid, for example in a quantity of 1 to 50 ml, through the filter assembly which is connected to the syringe, a high pressure is required which has to be generated by hand. In the case of known syringes, the liquid or other medium to be filtered is forced through the filter assembly by an inward movement of the piston rod and thus an inward movement of the piston disposed in the cylinder. Under such circumstances, the hand must apply considerable force. In the case of very dense filter materials or where several filter materials are connected in series, particularly diaphragm filters, filtration in this manner is impossible.

A syringe of this type is disclosed in United States patent application Ser. No. 750,427, filed Dec. 14, 1976.

Where turbid liquids, suspensions or liquids comprising material undergoing precipitation, and which are difficult to separate are employed with a syringe of this type, it may well be possible for the pores of the filter to be completely clogged before the whole liquid to be filtered is expelled from the first pressure chamber. As a result there are two possible dangers for the user of the syringe, that is to say: (1) Owing to the practically unlimited further build-up of pressure in the first pressure chamber on pumping via the second pressure chamber a guage pressure, exceeding the pressure rating of the first cylinder becomes established in the first pressure chamber. The bursting or explosion of the first cylinder and the liquid expelled from it will endanger the operator; (2) even if he notices the clogging of the filter pores promptly and stops pumping, the only possibility for the operator to reduce the gauge pressure obtaining in the first pressure chamber will be that of unscrewing the filter holder from the inlet/outlet duct connector with the inlet/outlet duct pointing upwards. The gauge pressure established in the first pressure chamber will then be released by virtue of the pneumatic working medium emerging through the loosened connection to the filter container. As it flows out of the pneumatic working medium will entrain vestiges of the liquid medium in the inlet/outlet duct and the medium will be expelled from the piston and spool pump. More particularly, in the case of the pressure filtration of toxic and/or corrosive media this will present a substantial source of danger for the user. The problem of unintended and irreversible clogging of the inlet/outlet of the first pressure space can therefore under certain circumstances certainly constitute a substantial source of danger for the user.

SUMMARY OF THE INVENTION

An object of the present invention is to provide a syringe of the aforedescribed nature which can easily be operated during the pressure filtration of liquid media and which is capable of being alternately filled and emptied without any effort and high pressures may be produced using simple and inexpensive seals.

A further object of the invention is to provide a syringe of the aforedescribed nature which offers a high degree of safety for the operator. In order to obtain this object, a syringe embodying the present invention is based on the principle that, using a coaxial manner of construction, a first piston in a first cylinder and a second piston in a second cylinder cooperate in such a manner that the first piston serves for induction of the liquid medium to be filtered and the second piston like an air pump extending through the first piston provides a space between the lower surface (working surface) and the top surface of the medium to be filtered, and into this space the pneumatic working medium, preferably air, is pumped with the creation of gauge pressure. This pressure of the pneumatic working medium, and not the piston surface of the first piston, forces the liquid to be filtered out of the first cylinder.

Owing to the construction of the pressure space under the first piston the space above the first piston in the first cylinder does not need to be hermetically sealed. As a result it is possible not only to dispense with seals but also to bring about a substantial simplification of the manipulation of the syringe as a whole, since the first piston in the first cylinder can easily be withdrawn. Withdrawing or pulling back of the first piston in the first cylinder can be used to draw the liquid to be filtered through the inlet/outlet duct into the first cylinder.

In accordance with a further aspect, a syringe embodying the present invention is based on the parallel use of two pressure release members, operating in the same direction, for the first pressure chamber. The safety factor which is provided by this measure cannot be created either by the one or the other member. It is only the joint use of the two release members, operating in the same direction, that is to say the gauge pressure safety valve and the venting screw, which can provide complete safety in the case of liquid media which are difficult to filter.

In accordance with a further object of the present invention the venting or pressure let-off screw is preferably provided with a central hole, which is closed by an excess pressure valve or a disc adapted to burst under excess pressure. Accordingly, the manually operated closure of the venting duct for the first channel additionally and simultaneously assumes the function of an automatic excess pressure device to that the first pressure chamber, which is subjected to unusually high gauge pressures, is provided with a threefold safety system.

Accidents due to unintended squirting of liquid to be filtered under pressure in the wrong direction are reliably avoided by a syringe constructed in accordance with the present invention.

The invention will now be described in what follows, with reference to one embodiment, in conjunction with the drawings.

DESCRIPTION OF THE PREFERRED EMBODIMENT

Figure 1:
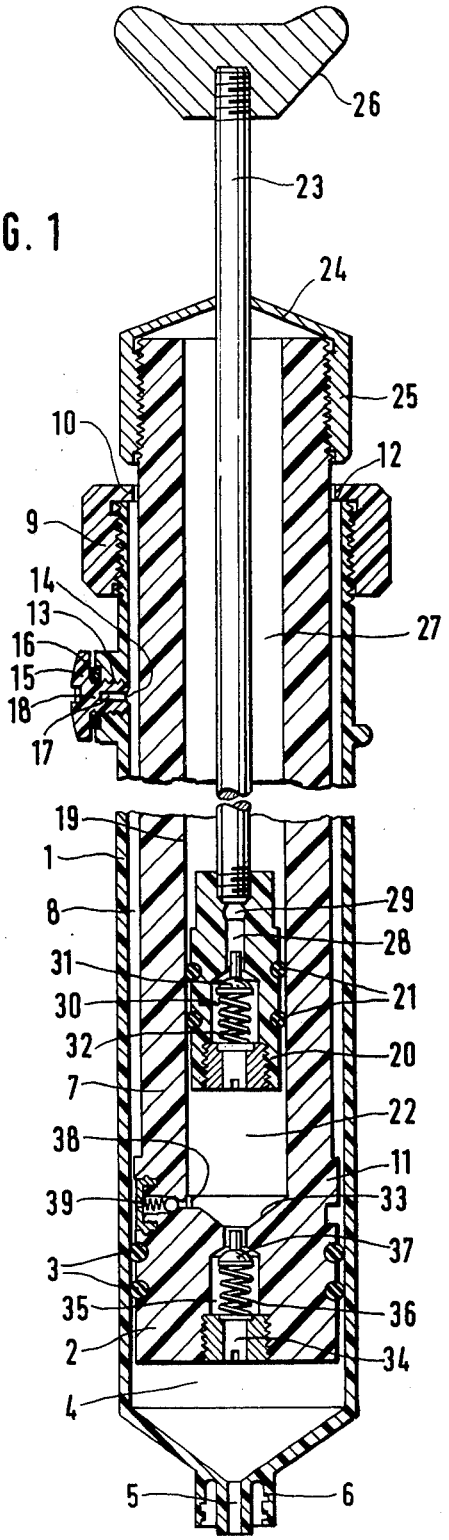
FIG. 1 shows one embodiment of the invention in axial section.

FIG. 1 shows substantially an axial section of an embodiment of the pneumatically operated syringe of the slide piston pump type constructed in accordance with the present invention. The syringe consists of a first cylinder 1, whose wall simultaneously serves as an external pump housing, and a first piston 2 fitted to suit this first cylinder in which it can slide axially. The first piston 2 is sealed by means of O-rings 3 with respect to the inner wall of the cylinder 1 in a gas-tight and liquid-tight manner and defines a first pressure chamber 4 in front of its working surface. The first pressure chamber 4 has an inlet/outlet duct 5 opposite the first piston 2 and the duct 5 can cooperate with a threaded connector 6 for screwing on, for example, a filter holder or a pressure flexible tube or it can itself be constructed as a threaded connector.

The first piston 2 is connected with a first piston rod 7 preferably with an integral construction. The diameter of the first piston rod 7 is only slightly smaller than the diameter of the piston 2 but, however, is at least so much smaller that between the inner wall of the first cylinder 1 and the outer wall of the first piston rod 7 a cylinder-shaped first piston rod chamber 8 remains for venting purposes. The first piston rod 7 is to the rear axially guided in a central hole in a screw-threaded closure cap 9 of the first cylinder 1. Between the outer wall of the first piston rod 7 and the inner edge of the central hole of the screw-threaded closure cap 9 there is an annular gap 10, which at any time guarantees rapid and complete venting and a rapid and complete pressure equalization in the first piston rod chamber 8.

The suction stroke of the first piston 2 is limited by the rear surface of the piston 1 or an abutment 11 constructed on the latter or on the first piston rod 7 striking against the frontal face 12 of the screw-threaded cap 9. The rear abutment element, cooperating with this frontal closure surface 12 of the screw-threaded cap 9, of the first piston 2 is in this respect so constructed that even when the first piston 2 is drawnback as far as the abutment the annular gap 10 in the terminal surface 12 is not blocked.

In the wall of the first cylinder 1 a venting duct 13 is formed to connect the first piston rod chamber 8 and the atmosphere. The opening 14 of the venting duct 13 is so arranged that it is just cleared with respect to a connection with the first pressure chamber 4 when the first piston 2 has been withdrawn as far as the abutment into its extreme suction stroke position. The venting duct 13 is provided with a female screw-thread and is closed in a gas- and liquid-tight manner by a pressure release screw 15 with an intermediate O-ring 16. The pressure release screw 15 is preferably provided with a central hole 17, which is closed by a disc 18 adapted to burst (not shown true to scale in FIG. 1) or by an excess pressure valve.

The first piston rod 7 is constructed as a tube, whose clearance bore forms a second cylinder 19. In this second cylinder 19 a second piston 20 is arranged with a close fit for axial sliding movement. The second piston 20 is sealed in a liquid- and gas-tight manner with respect to the inner wall of the second cylinder 19 by O-rings 21 and it terminates the second pressure chamber 22. The second piston 20 is at the rear provided with a second piston rod 23, which is guided axially in a central opening in the frontal wall 24 of a screw-threaded cap 25 and the cap for its part is screwed on the first piston rod 7 and terminates the second cylinder 19 at the rear. At its outer end the second piston rod 23 is provided with a handle 26.

On the rear side of the second piston 20 in the second cylinder 19 a second piston rod chamber 27 is formed, whose venting is ensured by means not shown in FIG. 1. For example, this venting can be ensured by a clearance being left between the second piston rod 23 at the position at which it passes through the frontal wall 24 of the screw-threaded cap 25 or it is possible to use a venting hole in the upper part of the second piston rod 7.

The second piston 20 has a coaxial air inlet duct 28, which opens at its one end directly into the second pressure chamber 22 and at its other end opens via a radial duct 29 into the vented second piston rod chamber 27. In the coaxial duct 28 a check valve 30 is mounted, which opens when vacuum is produced in the second pressure chamber 22 and closes when gauge pressure is produced in the second pressure chamber 22. The valve body 31 of this check valve 30 is preferably biased by a compression spring 32. The force of the spring 32 is so set that the check valve 30 is pressed with a slight biasing action against the valve seat when the second piston 20 is not actuated, while on the other hand during the suction stroke of the second piston 20 it is readily opened.

The working surface of the piston 20 is opposite to a preferably conically formed surface 33, arranged to the rear in the first piston 2 and delimiting the second pressure chamber 22. Into this limiting surface 33 of the second pressure chamber 22 there opens an axial duct 34, which connects the second pressure chamber 22 through the first piston 2 with the first pressure chamber 4. In this axial duct 34 a check valve 35 is mounted, which opens, when the pressure in the second pressure chamber 22 is greater than the pressure in the first pressure chamber 4 by a predetermined difference and closes when the pressure in the first pressure chamber 4 is larger, the same as or smaller, up to a predetermined difference, than in the second pressure chamber 22. The threshold pressure required for opening the check valve 35 and which takes into account the above-mentioned pressure difference, is dimensioned in this respect in such a manner that the check valve 35 does not open on drawing the liquid medium through the inlet/outlet duct 5 during the suction stroke of the first piston 2, but on the other hand no excessive resistance is offered to the pressure stroke of the second piston 20 on forcing the gaseous working medium out of the second pressure chamber 22 into the first pressure chamber 4. The necessary biasing action of the check valve 35 is preferably provided by a compression spring 36, which acts upon a valve member or body 37.

Furthermore, a radial duct 38 opens into the second pressure chamber 22 and it connects the second pressure chamber 22 with the vented first piston rod chamber 8 and has an excess pressure valve 39 mounted in it, which opens when a predetermined limiting pressure in the second pressure chamber 22 is exceeded. The opening pressure of the excess pressure safety valve 39 is set in accordance with the maximum permitted pressure in the first pressure chamber 4. The opening pressure of the excess pressure safety valve 39 is substantially larger than the opening pressure of the check valve 37.

Figure 2:
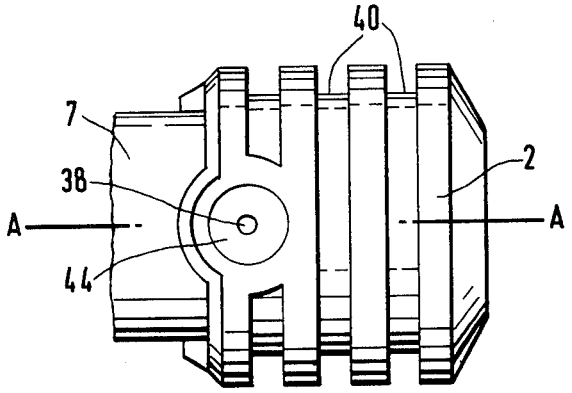
FIG. 2 shows the first piston with the boss of the first piston rod and the excess pressure safety valve in elevation.
Figure 3:
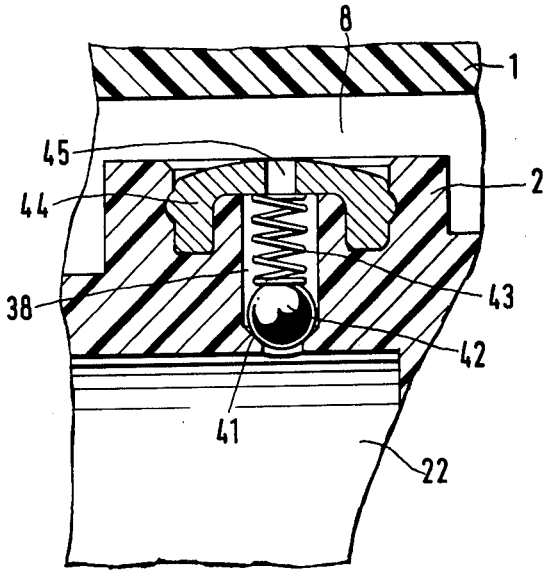
FIG. 3 shows a part axial view on the line A—A of FIG. 2.

One embodiment of the excess pressure safety valve 39 is shown on an enlarged scale in FIGS. 2 and 3. FIG. 2 is an elevation of the first piston 2 which is integrally molded on the first piston rod 7. In the first piston 2 annular grooves 40 are constructed, in which the sealing elements shown in FIG. 1 are located. Behind these sealing elements a radial duct 38, connected with the second pressure chamber 22, opens freely into the vented first piston rod chamber 8 (see FIG. 1).

In FIG. 3 a section on the line A—A of FIG. 2 will be seen. The first pressure chamber 22 is connected with the first piston rod chamber 8 by the radial duct 38. Just before its opening into the second pressure chamber 22 the radial duct 38 has a conical tapered part, which serves as a valve seal 41. The valve seal 41 cooperates with a ball operating as a valve body or member 42. The valve body 42 is acted upon by a compression spring 43. As a counter-abutment for the coil valve spring 43 a cap 44 is provided, which has a central hole 45. The counter-abutment cap 44 is fixed by screwing in, snapping in or in any other suitable manner in a corresponding recess in the outer wall of the first piston 2. In a similar manner the excess pressure safety valve can naturally also be constructed in the foot of the first piston rod 7.

The pressure required for opening the excess pressure safety valve 39 in the second pressure chamber 22 is determined by the force of the spring 43, which acts upon the valve body 42.

Preferably, the first cylinder 1, the screw-threaded cap 9, the pressure release screw 15, the first piston 2 with the first piston rod 7 and the second piston 20 consist of plastics as for example polycarbonate. The sealing elements 3, 16 and 21 are preferably made of silicone rubber. The valve bodies and the valve springs and the second piston rod 23 are preferably made of metal, more particularly stainless steel.

Before use of the syringe, the first piston 2 and the second piston 20 are pushed into their highest pressure stroke position. The inlet/outlet duct 5 for the liquid medium is connected with the supply, from which the sample is to be taken.

Then the user grasps the handle 26 and by means of the piston rod 23 draws the second piston 20 in the suction stroke direction to such an extent that its rear parts strike against the frontal wall 24 of the screw-threaded cap 25. On further pulling on the handle 26 via the first piston rod 7, the first piston 2 can be drawn in the first cylinder 1 back in the suction stroke direction. Since owing to the biasing of the check valve 35 the latter does not open, the liquid medium to be put under pressure is drawn in through the inlet/outlet duct 5. It can for example be a question of medium to be filtered. The suction stroke can be continued until the abutment 11 strikes against the frontal wall 12 of the screw-threaded cap 9, but if required can be stopped before this. The suction stroke of the first piston 2 can therefore be carried out in order to perform a metering function.

After the end of drawing in, the liquid phase of the pump is preferably held with the inlet/outlet duct 5 vertically upwards.

In this position, if it should not have already been done during drawing in, the first piston 2 is withdrawn back as far as the abutment in the suction stroke position. Following this the inlet/outlet duct is connected with the device into which the drawn in liquid phase is to be transferred under pressure, as for example with a pressure filter chamber. Following this the pump is turned again in such a manner that the inlet/outlet duct 5 is directed downwards.

The operator now takes hold of the pump on the outer wall of the first piston rod 7, which has now been practically completely withdrawn from the cylinder 1. Simultaneously, he will push in the second piston 20 by means of the second piston rod 23 into the second cylinder 19 for the first pressure stroke. When this is done the excess pressure valve 30 will close and the gaseous working medium which has flown on withdrawal of the second piston 20 out of the vented second piston rod chamber 27 via the radial duct 29 and the axial duct 28 through the opened check valve 30 into the pressure chamber 22 will be compressed. This gaseous working medium will as a rule be air, but could, however, readily be a protective gas or an inert gas, which is supplied to the second piston rod chamber 27 via an inlet connector, now shown in the drawings, in the vicinity of the screw-threaded cap 25, under normal pressure or with a very slight degree of gauge pressure. If such a protective gas is supplied to the second piston rod chamber 27 under gauge pressure, this pressure must in any case be less than the biasing action acting on the valve body 31 of the check valve 30 in the closing direction.

Owing to the pushing of the second piston 2 into the second cylinder 19, the pressure in the second pressure chamber 22 increases more and more and finally it exceeds the opening pressure of the check valve 35 in the axial duct 34 of the first piston 2. The pneumatic working medium is then transferred during the further course of the pressure stroke of the second piston 20 out of the second pressure chamber 22 into the first pressure chamber 4.

After termination of this first pressure stroke, the second piston 20 is again drawn back for a suction stroke by means of the second piston rod 23. Then the check valve 35 in the first piston 2 closes and the check valve 30 in the second piston 20 opens and as a result pneumatic working medium again passes into the second pressure chamber 22. Following this the second pressure stroke part occurs, the events as described above being repeated.

Owing to repeated pumping without any change in position of the first piston 2 which is drawn back as far as necessary for abutment in the suction stroke position, a greater and greater gauge pressure is built up in the first pressure chamber 4 above the drawn in liquid owing to the pneumatic working medium. When the opposing pressures have been overcome this increasing gauge pressure forces the liquid of the inlet/outlet duct 5, for example through a pressure filter.

After the whole liquid has been expelled from the first pressure chamber 4 and the inlet/outlet duct, the receiving device, in this case therefore the pressure filter holder, is removed from the inlet/outlet duct 5. Following this, both the first piston 2 and also the second piston 20 are pushed back into their highest pressure stroke position so that the pump is ready for use for the next working cycle.

If the normal course of functioning of the pump as just described is impeded by such high opposing pressures being established in the inlet/outlet duct owing to external effects as for example clogging of the filter, so that the liquid can no longer be expelled out of the first pressure chamber 4, by further pumping with the piston 20 firstly, the working pressure in the first pressure chamber 4 can be further increased. The check valve 35 then opens as soon as a predetermined pressure is exceeded in the first pressure chamber 4. This predetermined pressure opening is controlled by proper selection of the strength of spring 43 of the check valve 35. With the check valve 35 opened there is then a pressure equalization between the second pressure chamber 22 and the first pressure chamber 4 owing to the transfer of the working medium. With the inlet/outlet duct 5 closed, the pressure necessary for opening the check valve 35 will become larger and larger in the second pressure chamber 22 from one pressure stroke to another. Owing to the smaller working cross-sectional area of the second piston 20 a pressure may become established in the first pressure chamber 4, which in certain circumstances might lead to bursting of the first cylinder 1. In order to ensure that this does not happen the first pressure chamber 22 is connected via the excess pressure safety valve 39 with the vented first piston rod chamber 8. This excess pressure valve 39 is so biased that it opens before the critical limiting pressure in the first pressure chamber 4 is exceeded. On the first pressure stroke of the second piston 20, at which this critical limiting pressure would be exceeded in the first pressure chamber 4, it is therefore no longer the check valve 35 which opens but in its stead the excess pressure safety valve 39, whose opening pressure is larger than the opening pressure of the check valve 35. Therefore, even if the operator does not notice the clogging of the inlet/outlet duct 5, he can continue to pump using the second piston 20 without danger; that is to say, without further increase in the pressure in the first pressure chamber 4. The second pressure chamber 22 is relieved via the excess pressure safety valve during each of these pressure strokes carried out in the circumstances. Any bursting of the first cylinder 1 is therefore prevented.

When the user notes clogging of the inlet/outlet duct 5, he can readily open the pressure release screw 15, with the pump still held downwards, and so bring about pressure equalization in the first chamber 4. Following this the pressure release screw 15 is done up tight again and the pump is so turned round that the inlet/outlet duct 5 points upwards. The liquid which remains in the first pressure chamber 4 then flows back on to the first piston 2 in the suction stroke position and clears the inlet/outlet duct 5. In this position the liquid receiving device, for example the pressure filter holder, can be removed without any danger, since the first pressure chamber 4 is completely relieved of pressure. If the user were to remove the receiving device with the same manipulations while the first pressure chamber 4 was still under the limiting pressure, the pneumatic working medium flowing out under a high pressure would squirt out the liquid remaining in the inlet/outlet duct and possibly in parts of the receiving device and this would accordingly jeopardize the user. This danger is not possible with the aforedescribed syringe of the present invention.

To cover the unlikely possibility of the excess pressure safety valve 39 becoming clogged, jammed or corroded in such a manner that it does not open even when the critical limiting pressure is reached, it is possible to provide a double security system preferably by the inclusion of a bursting disc or a second excess pressure valve like valve 39 in the pressure release screw 15. The bursting pressure or, respectively, the pressure of an excess pressure valve in the pressure release screw 15 is in every case larger than the opening pressure of the check valve 39 in order to permit direct outflow of the pneumatic working medium from the cylinder only when the upstream excess pressure safety valve 39 fails. This measure is adopted more particularly since on opening of the excess pressure safety valve 39 a very much lower volumetric flow is required for restoring normal operational conditions than is the case with an opening only of the second pressure equalization safety device 18.

Various modifications and changes may be made with respect to the foregoing detailed description without departing from the spirit of the present invention.

We claim:

1. A syringe for expelling a liquid medium for filtration, said syringe comprising:

a first cylinder cooperating with a first piston having a first hollow piston rod and defining a first pressure chamber, the hollow portion of said hollow piston rod defining a second cylinder having a smaller cross section than said first cylinder and cooperating with a second piston having a second piston rod and defining in said second cylinder a second pressure chamber, the space between said first cylinder and said first hollow piston rod defining a first piston rod chamber;

a cap on the rear of said piston rod with its inner diameter forming a gap relative to said second piston rod, said cap limiting the stroke of said second piston rod by abutment with the latter;

an axial duct formed within said first piston connnecting said first and second pressure chambers;

a check valve in said duct having a valve closure element and means biasing said valve closure element to open the valve upon an over-pressure in said second pressure chamber;

an inlet/outlet attachment on said first cylinder for the liquid medium opening into said first pressure chamber;

a second duct formed in said second piston opening into said second pressure chamber;

a second check valve in said second duct that opens in response to an under-pressure in said second pressure chamber during an air intake stroke of said second piston and that closes in response to an air over-pressure in said second pressure chamber during an air pressurizing stroke of said second piston;

a second cap for said first cylinder with its inner diameter forming a gap relative to the outer surface of said first piston rod;

a stop on said first piston which is able to abut said second cap in the extreme intake stroke position of the first piston, with said liquid medium charged into said first pressure chamber by means of an intake stroke of the first piston being expelled by means of an air over-pressure provided upon said liquid medium within said first pressure chamber by means of a pumping action of said second piston;

a pressure release duct connecting said second pressure chamber and said first piston rod chamber forwardly of the most forward point of travel of said second piston; and a pressure safety valve in said duct that opens when the pressure in the said first and second pressure chambers exceeds a predetermined pressure to thereby equalize the pressure of said liquid medium in said first and second pressure chambers and prevent bursting of said first cylinder.

2. A syringe according to claim 1, wherein:

said first cylinder is provided with a venting duct that connects said first piston rod chamber and the atmosphere, said duct being arranged forwardly of the rearmost position to which said first piston is movable, said venting duct being provided with pressure release means for said liquid medium.

3. A syringe according to claim 2, wherein:

said pressure release means opens at a pressure which is greater than the predetermined pressure at which said pressure safety valve opens.

4. A syringe according to claim 2, wherein:

said pressure release means is readily removable from said first cylinder.

5. A syringe according to claim 3, wherein:

said pressure release means is readily removable from said first cylinder.

* * * * *